US009834979B2

(12) United States Patent
Ge et al.

(10) Patent No.: US 9,834,979 B2
(45) Date of Patent: Dec. 5, 2017

(54) ARCUATE DRIVE THROUGH BIN DOOR ASSEMBLY

(71) Applicant: SUKUP MANUFACTURING CO., Sheffield, IA (US)

(72) Inventors: Tun Ge, Sheffield, IA (US); John A. Hanig, Sheffield, IA (US); Bradley A. Poppen, Sheffield, IA (US)

(73) Assignee: Sukup Manufacturing Co., Sheffield, IA (US)

( * ) Notice: Subject to any disclaimer, the term of this patent is extended or adjusted under 35 U.S.C. 154(b) by 220 days.

(21) Appl. No.: 14/551,320

(22) Filed: Nov. 24, 2014

(65) Prior Publication Data

US 2016/0145930 A1 May 26, 2016

(51) Int. Cl.

| | |
|---|---|
| ***E06B 1/14*** | (2006.01) |
| ***E06B 1/52*** | (2006.01) |
| ***E06B 1/00*** | (2006.01) |
| ***E06B 11/02*** | (2006.01) |
| ***E05C 19/14*** | (2006.01) |

(52) U.S. Cl.

CPC ..... *E06B 1/14* (2013.01); *E05C 19/14* (2013.01); *E06B 1/006* (2013.01); *E06B 1/52* (2013.01); *E06B 11/02* (2013.01)

(58) Field of Classification Search

CPC ..... A01F 25/163; E04H 7/22; E04H 7/30; B65D 90/008; B65D 90/54; B65D 90/623; E06B 1/006

See application file for complete search history.

(56) References Cited

U.S. PATENT DOCUMENTS

| | | | | | |
|---|---|---|---|---|---|
| 1,134,663 | A * | 4/1915 | Beltz | B65D 90/54 | 52/193 |
| 2,068,972 | A * | 1/1937 | Bangert | B65D 90/54 | 52/193 |
| 2,367,720 | A * | 1/1945 | Goldbeck | B65D 90/54 | 52/193 |
| 3,048,946 | A * | 8/1962 | Hawk | B65D 90/54 | 193/9 |
| 3,605,342 | A * | 9/1971 | Koser | B65D 90/54 | 49/464 |
| 3,987,596 | A * | 10/1976 | Wolf | B65D 90/54 | 49/246 |
| 3,997,025 | A * | 12/1976 | Price | B65D 90/54 | 182/77 |
| 4,043,465 | A * | 8/1977 | Rutten | A01F 25/2009 | 414/318 |
| 4,047,691 | A * | 9/1977 | Wolf | A01F 25/163 | 249/39 |

(Continued)

OTHER PUBLICATIONS

"Chief Agri/Industrial Division: Commercial Grain Management Systems," Apr. 2014, pp. 1-8, IB2.5MO4/14, Chief Agri/Industrial Division.

(Continued)

*Primary Examiner* — Katherine Mitchell
*Assistant Examiner* — Catherine A Kelly
(74) *Attorney, Agent, or Firm* — Zarley Law Firm, P.L.C.

(57) ABSTRACT

A drive through bin door having a curved bottom I-beam connected to an inner and outer door frame. The door frames have a curved top member connected to a pair of posts by a plurality of nuts and bolts. A door panel is hingedly connected to one of the door frames.

12 Claims, 8 Drawing Sheets

(56) References Cited

U.S. PATENT DOCUMENTS 4,373,623 A * 2/1983 Bruecker ..... A01F 25/163 193/14
4,376,360 A * 3/1983 Hanson ..... B65D 90/10 52/193
4,453,351 A * 6/1984 Moore ..... E04H 7/30 52/192
4,480,408 A * 11/1984 Deuman, Sr. ..... B65D 90/10 49/254
4,480,534 A * 11/1984 Sloan ..... B65D 88/741 454/182
4,610,376 A * 9/1986 Regent ..... E04H 7/30 220/4.17
4,884,617 A * 12/1989 Coenraets ..... E06B 9/581 160/190
4,913,478 A * 4/1990 Grossman ..... E05C 3/047 292/259 R
5,088,871 A * 2/1992 Mellish ..... B65G 65/42 198/550.8
5,383,313 A * 1/1995 Deeke ..... E04H 1/1205 49/366
6,851,847 B2 * 2/2005 Sukup ..... A01F 25/186 366/261
7,845,129 B2 * 12/2010 Holschlag ..... E04H 7/30 454/182
8,286,394 B2 * 10/2012 Grossman ..... E04H 7/30 52/194
2003/0172593 A1 * 9/2003 Musser ..... E04H 7/30 49/463
2015/0121795 A1 * 5/2015 Rauser ..... E04H 7/30 52/578

OTHER PUBLICATIONS

"Behlen Grain Systems: Commercial Series M15-M32 (49'-105')," Jan. 2015, pp. 1-16, AD-152271, Behlen Mfg. Co.
"GSI: VTDL-135'—8'×9' Door Assembly w/Manway: Instruction Manual: PNEG-1655;" Jan. 7, 2011; cover page, pp. 23-24; GSI.
"Brock: 12'×12" [3 658×3658] Drive-In Door;" Supplement Manual, May 2000; cover page and p. 25; MCB1623A, Brock.
"Commercial Bin Series: Bin Entry," Oct. 26, 2011; www.behlengrainsystems.com/commercial-BINENTRY.htm.

* cited by examiner

ARCUATE DRIVE THROUGH BIN DOOR ASSEMBLY

BACKGROUND OF THE INVENTION

This invention is directed to a drive through bin door and more particularly to a drive through bin door that is angled/curved.

Drive through bin doors are known in the art. Known drive through doors have a straight top and a straight bottom I-beam. During erection, it is often difficult to assemble a straight door bin with a circular bin and often results in a miss-fit or twist of the sidewall sheets which reduces the structural strength of the bin. Known drive through doors also lead to the complexity of the foundation in order to accommodate the straight bottom I-beam and are also difficult to fit into smaller diameter bins.

The assembly of current drive through bin doors require critical joints to be field welded. Thus, the structural integrity of the door is dependent upon the quality of the weld. Also, because current doors are not designed heavy enough to handle hoop tension loads, a pair of door panels are bolted to a vertical member. To open the door requires the removal of hundreds of bolts which is labor intensive, inconvenient, and time consuming. Therefore, a need exists in the art for a drive through bin door that addresses these deficiencies.

An objective of the present invention is to provide a drive through bin door that closely follows the curvature of a grain bin.

Another objective is to provide a drive through bin door that is easy to assemble in the field.

A still further objective is to provide a drive through bin door that is easy to open and close.

Yet another objective is to provide a drive through bin door frame designed to take all hoop tension loads.

A still further objective is to provide a drive through bin door that minimizes or eliminates field welding.

These and other objectives will be apparent to one of ordinary skill in the art based upon the following written description, drawings, and claims.

SUMMARY OF THE INVENTION

A drive through bin door having a generally arcuate (i.e., angled/curved) bottom I-beam connected to an inner and outer door frame. The door frames have a curved top member connected to a pair of posts by a plurality of nuts and bolts. A door panel is hingedly connected to one of the door frames.

Sandwiched between the door frames, which are bolted together, are a horizontal wall panel and a pair of vertical wall panels. A pair of sealing plates connect the horizontal wall panel to the vertical wall panel. Also a secondary door is hingedly connected to the door panel to cover an opening in the door panel.

DETAILED DESCRIPTION OF THE PREFERRED EMBODIMENTS

Figure 1:
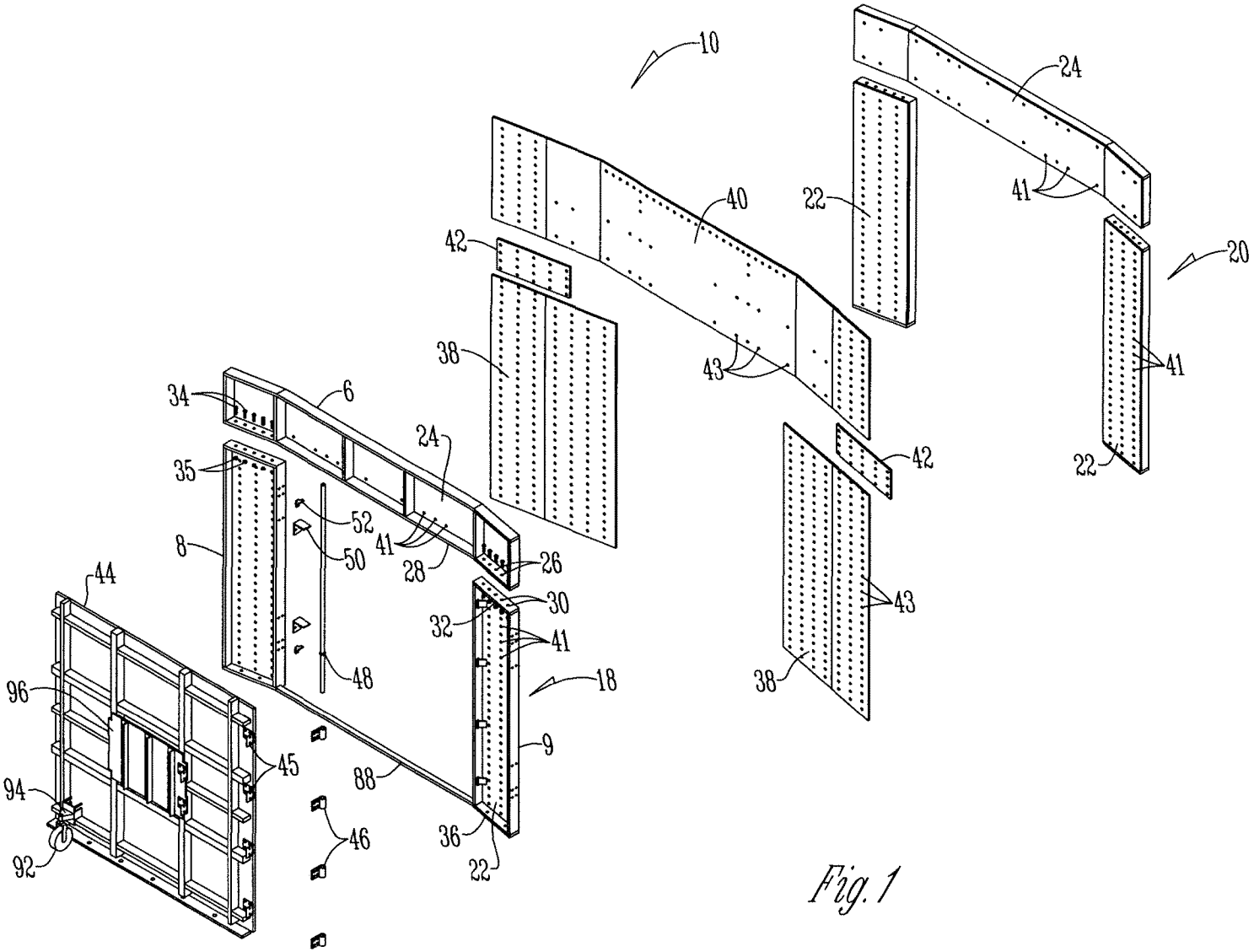
FIG. 1 is an exploded view of a drive through bin door.
Figure 2:
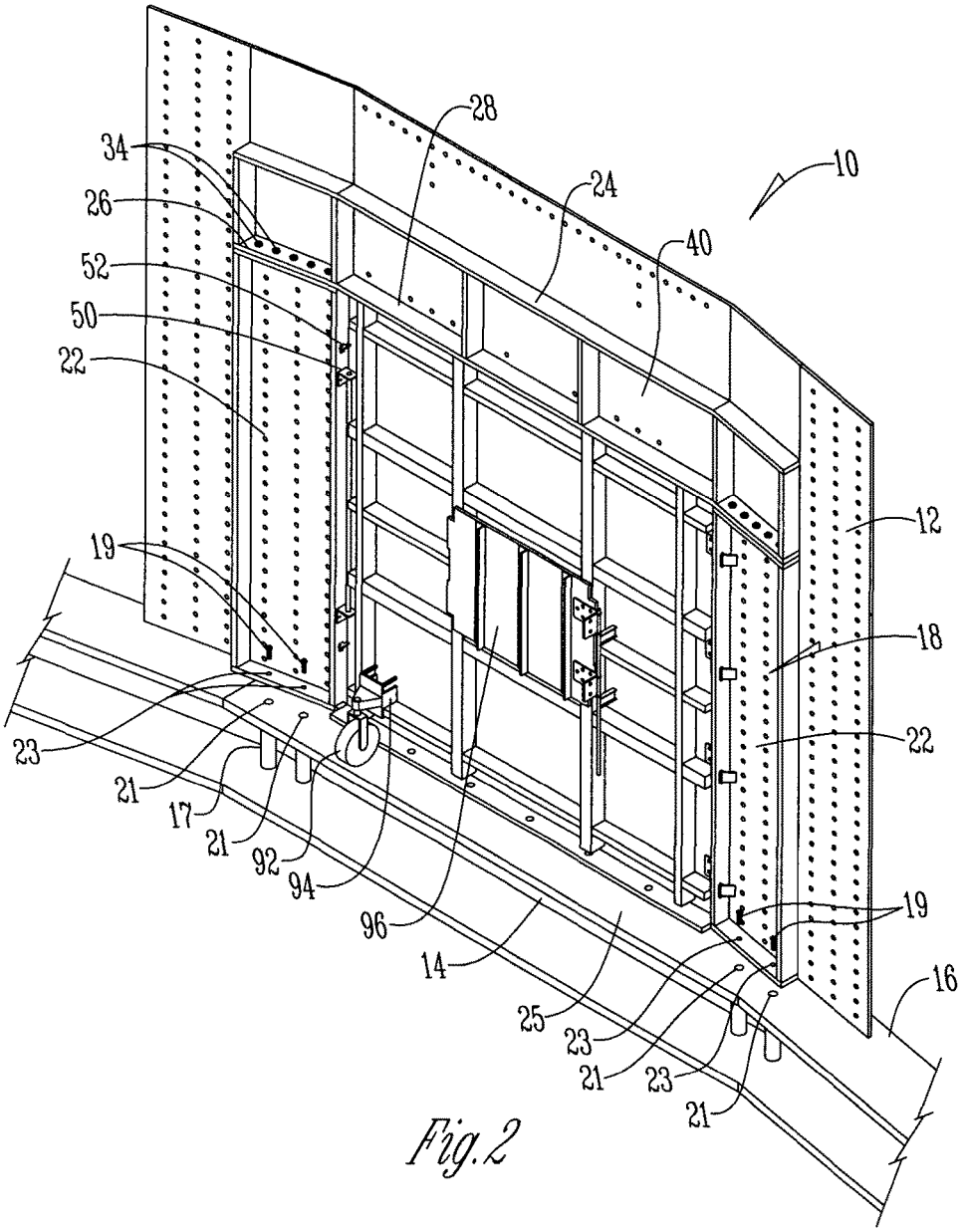
FIG. 2 is a perspective view of a drive through bin door.
Figure 3:
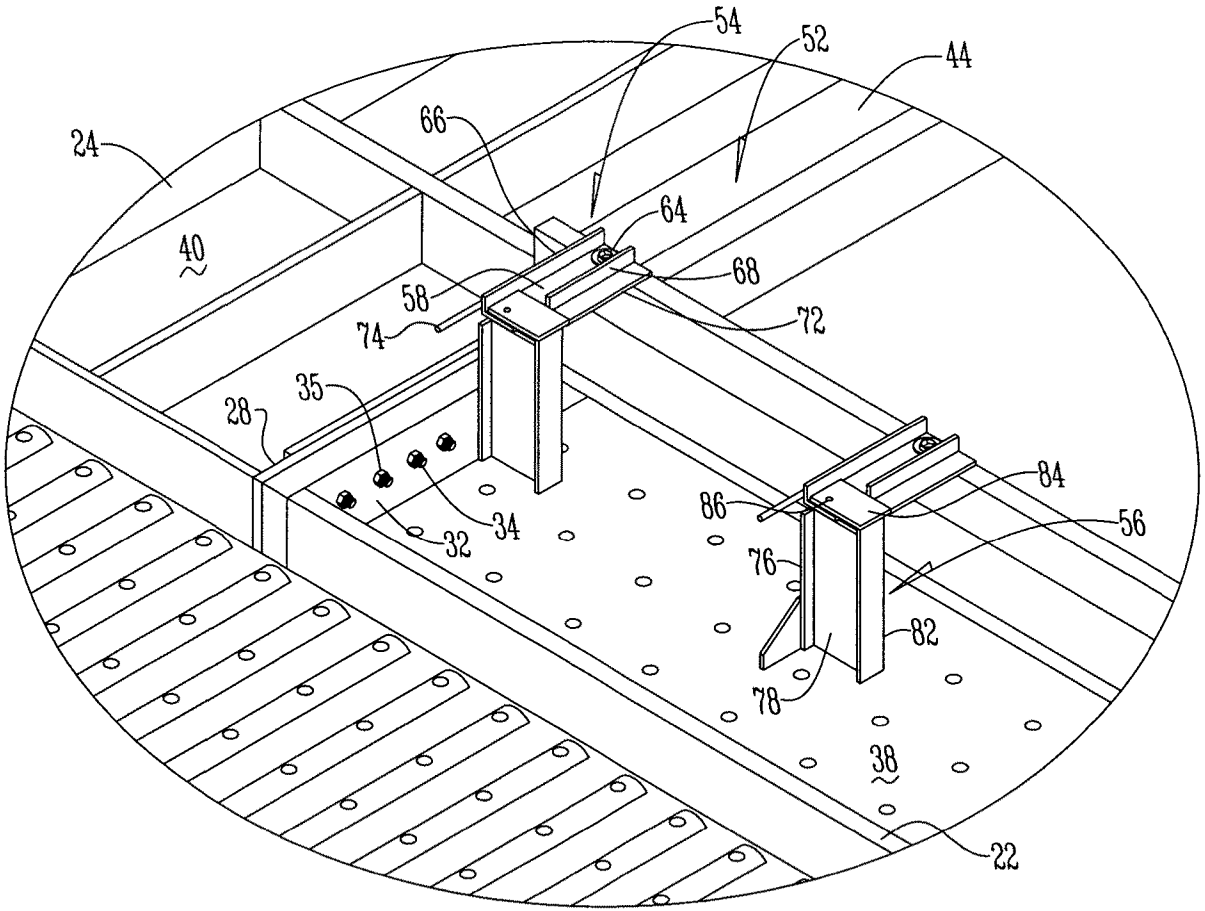
FIG. 3 is a partial perspective view of a drive through bin door.
Figure 4:
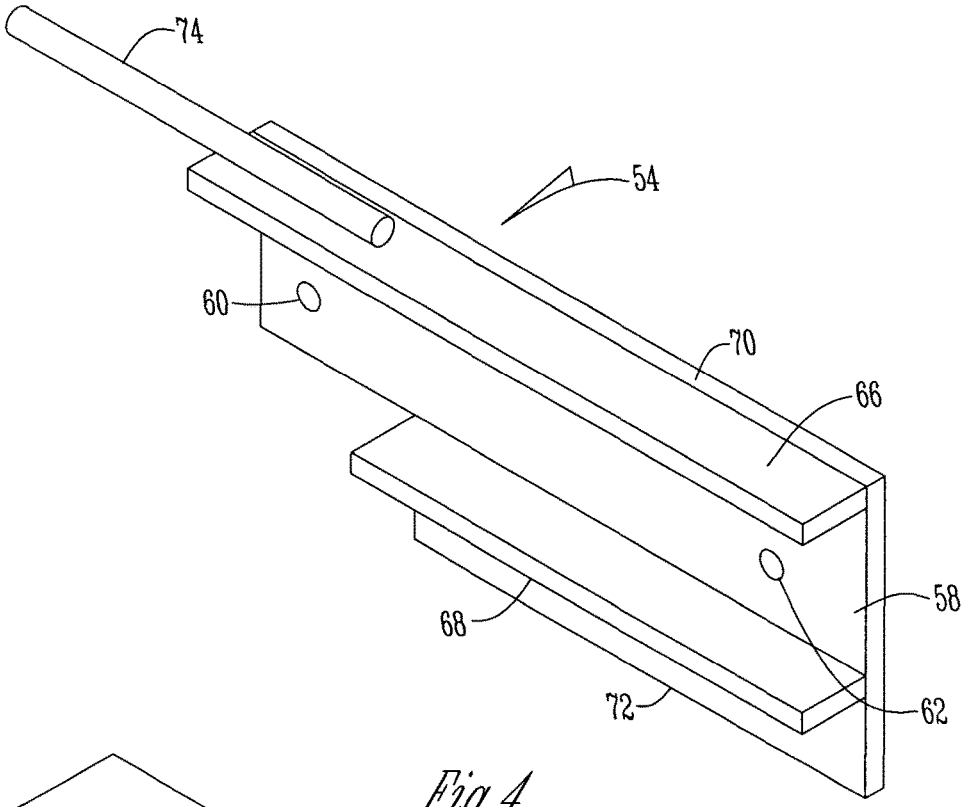
FIG. 4 is a perspective view of a latch of a latch assembly.
Figure 5:
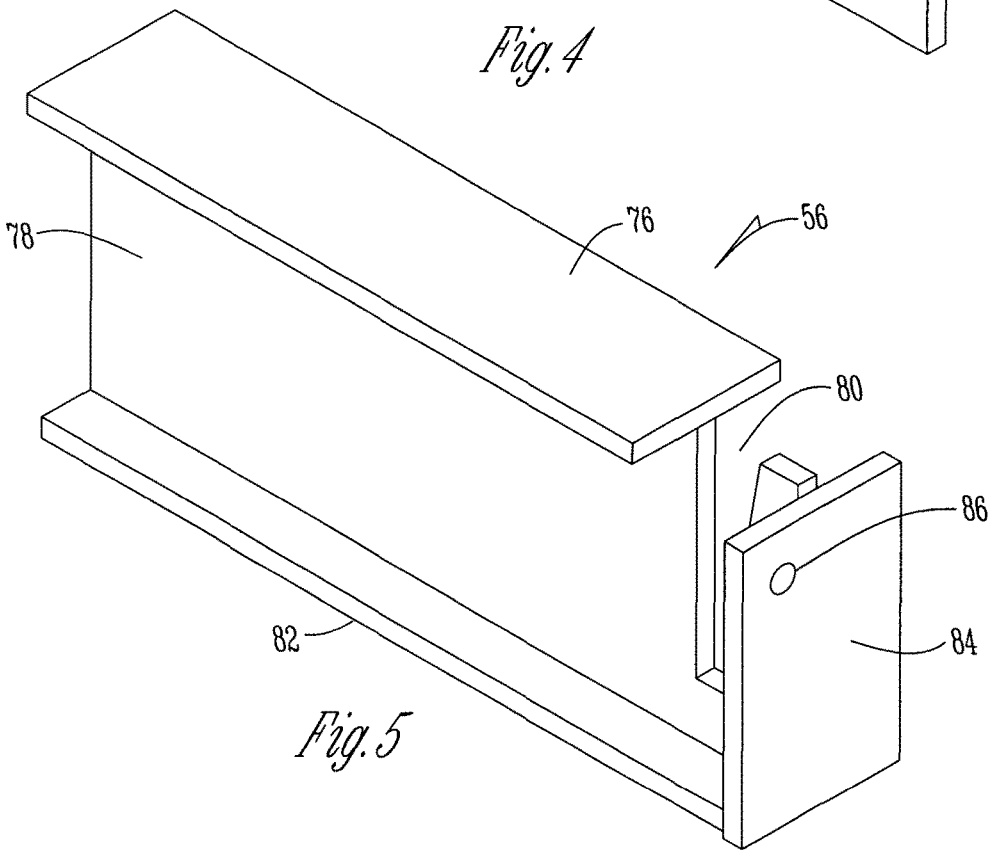
FIG. 5 is a perspective view of a catch of a latch assembly.
Figure 6:
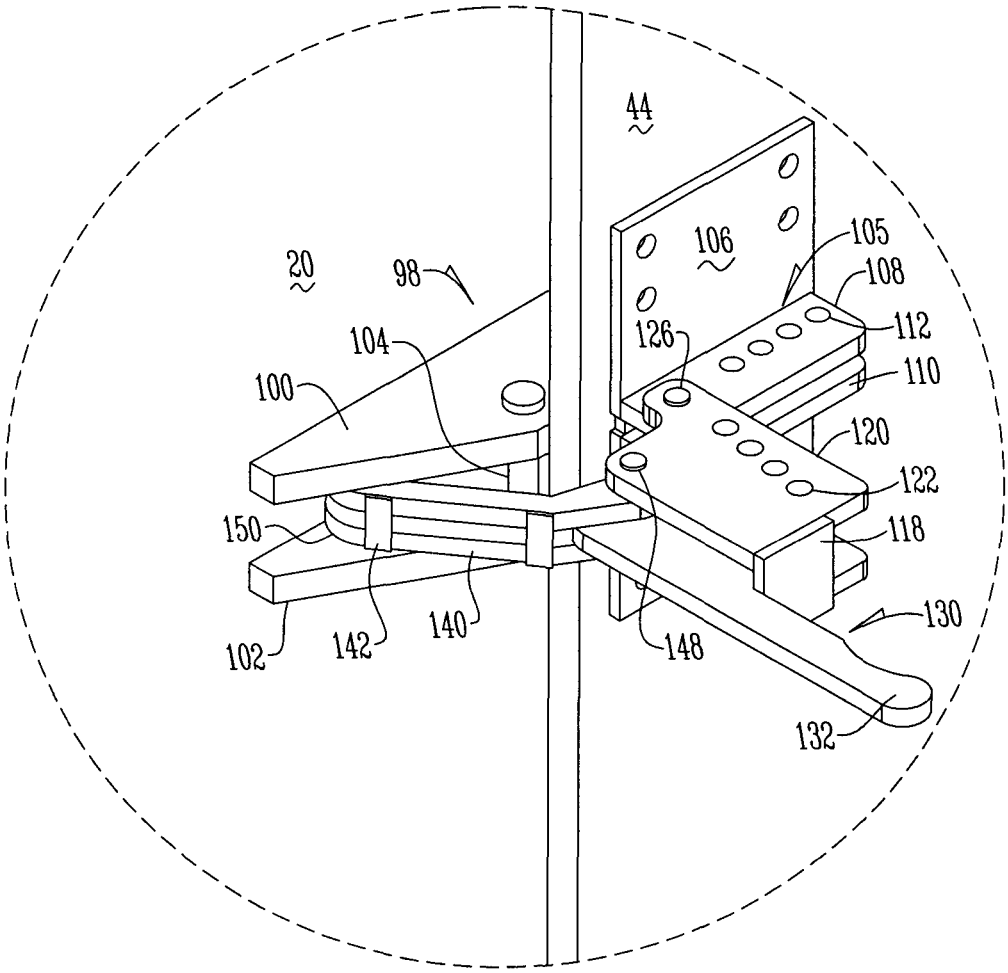
FIG. 6 is a perspective view of a latch assembly.
Figure 7:
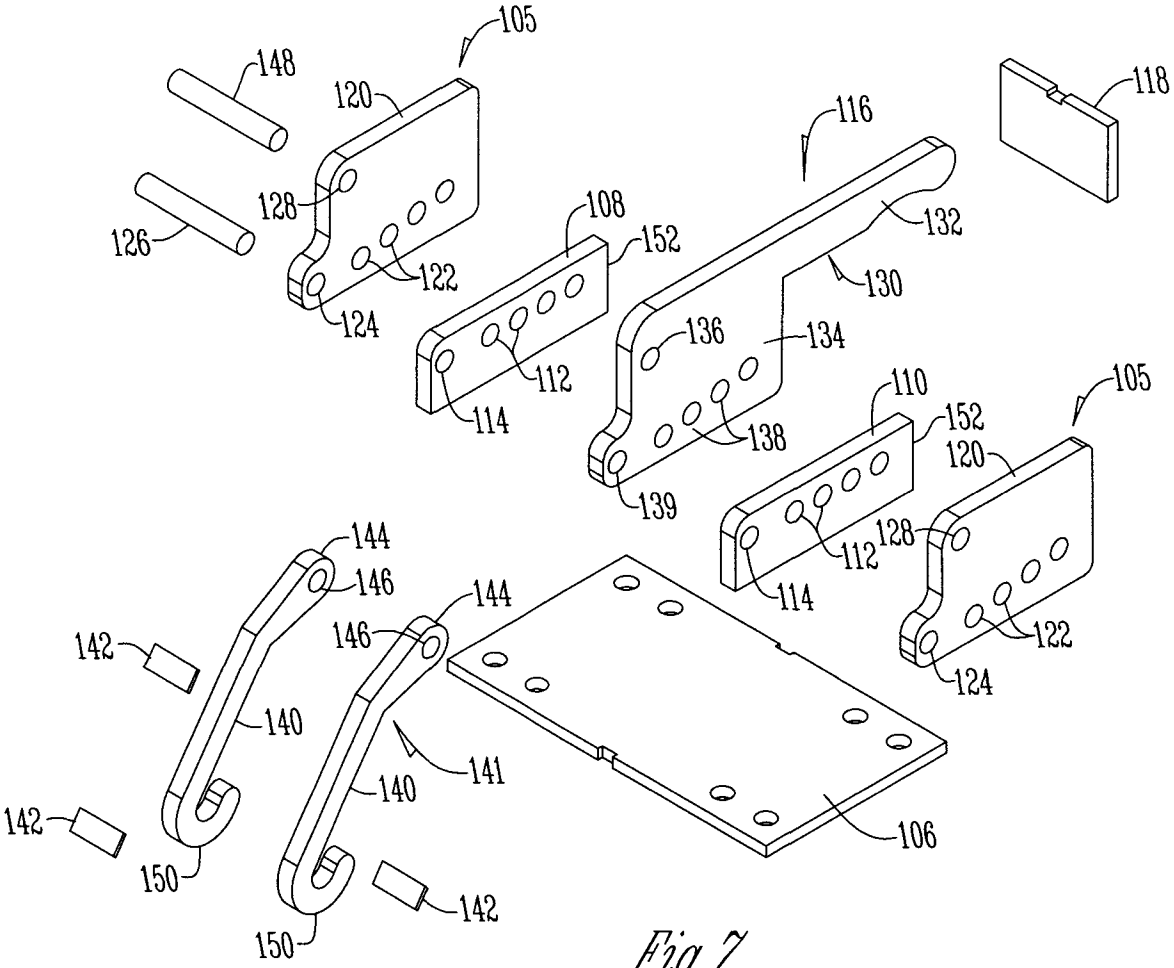
FIG. 7 is an exploded view of a latch assembly.
Figure 8:
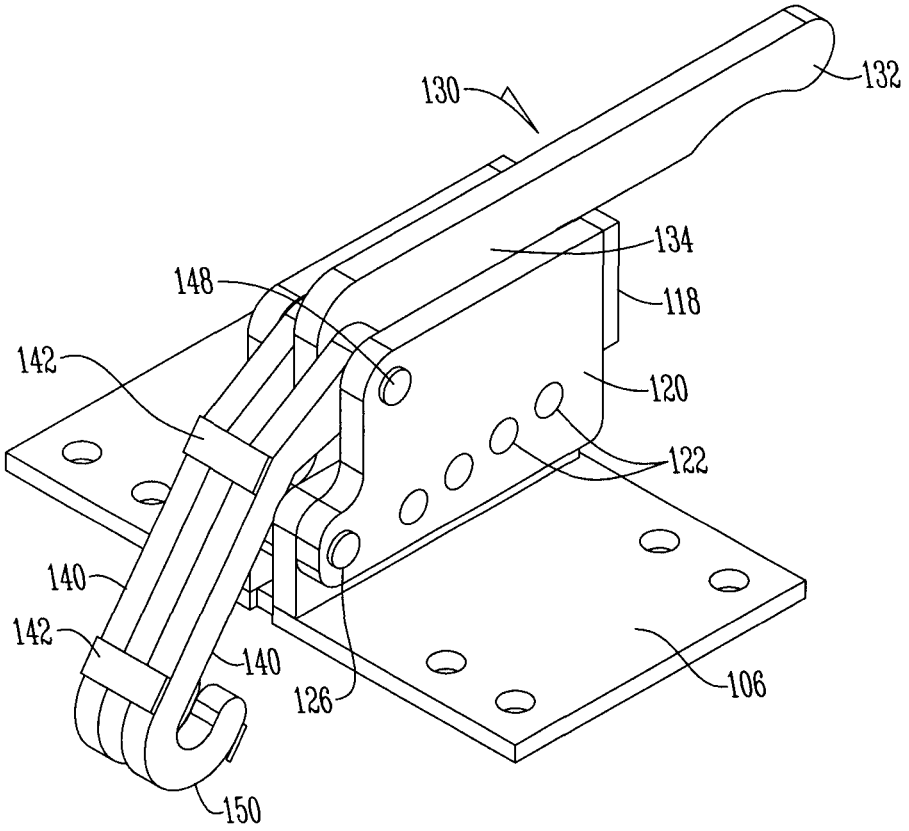
FIG. 8 is a perspective view of a latch assembly.
Figure 9:
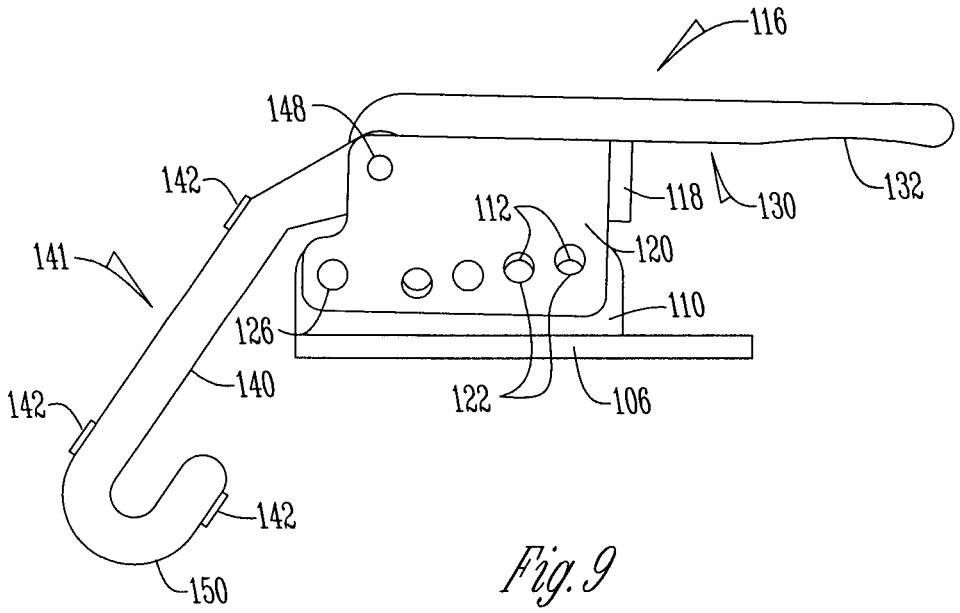
FIG. 9 is a side view of a latch assembly.

Referring to the Figures, a drive through bin door 10 for use with a grain bin 12 includes a bottom built-up I-beam 14 which is set into the foundation stemwall 16 when poured. The bottom I-beam 14 is generally arcuate with an angle and/or curve and closely follows the curvature of the grain bin 12. An inner 18 and outer 20 door frame are connected to the bottom I-beam 14. More specifically, as shown in FIG. 2, the I-beam has a plurality of spacers 17. Holes 23 in the inner 18 and outer 20 door frame align with openings 21 in an upper flange 25 of the I-beam such that the bolts 19 are threadably received in nuts (not shown) that are welded to the bottom of the upper flange 25 and the spacers 17. The door frames 18 and 20 each have a pair of cold formed C-channel posts 22 connected to a built-up angled/curved C-channel member 24 that is transverse to and positioned above the posts 22. The C-channel member 24 has a plurality of openings 26 that extend through a portion of a bottom side 28 of the member 24 and align with openings 30 in a top side 32 of the posts 22. A plurality of bolts 34, secured by nuts 35, extend through openings 26 and 30 to secure the C-channel member 24 to the posts 22. The bottom side 36 of the posts 22 are secured to the I-beam 14 with bolts 19 or alternatively the posts 22 are field welded to the bottom I-beam 14.

A pair of vertical 38 and a horizontal 40 frame or wall panel is positioned between the inner and outer door frames 18 and 20. A pair of sealing plates 42 are bolted to the frame or wall panel 38 and 40 to connect and seal the frame or wall panel 38 and 40. With the frame or wall panel 38 and 40 sandwiched between inner and outer door frames 18 and 20, the door frames are bolted together. More specifically, the door frames 18 and 20 have a plurality of apertures 41 that are aligned with one another and aligned with apertures 43 on wall panels 38 and 40. As such, a plurality of bolts are inserted through apertures 41 and 43 and with a nut 35 secure the door frames 18 and 20 and wall panels 38 and 40 together.

A door panel 44 is hingedly connected to the inner door frame 18 using a plurality of hinge brackets 46 and a hinge pin 48. The door panel 44 may open inwardly or outwardly. Opposite the hinge brackets 46 and secured to the inner door frame 18 are a plurality of guides 50 and an adjustable latch 52. The latch assembly is of any type and preferably includes a latch 54 pivotally attached to the door panel 44 that is positioned to be selectively received within a catch 56 that is attached to the outer door frame 20. The latch 54 has an arm 58 having a first aperture 60 and a second aperture 62. A pivot pin 64 is received through aperture 62 to pivotally connect latch 54 to the door panel 44. An upper 66 and lower 68 flange extend outwardly and transversely from the arm 58. The upper flange 66 is positioned adjacent a top edge 70 of the arm and extends the length of the arm 58. The lower flange 68 is positioned adjacent a lower edge 72 of the arm 58 and extends only a partial length of the arm 58. A handle 74 is connected to the top of the upper flange 66 and extends beyond the arm 58 at an end opposite the pivot pin 64.

The latch 54 is mounted and preferably welded, via a mounting plate 76, to the outer door frame 20 such that the catch 56 is transverse in relation to the latch 54. A vertical plate 78 having a notch 80 adjacent one end is connected to a bottom surface of the mounting plate 76. Connected to the bottom of the vertical plate 78 is a horizontal support plate 82. An end plate 84 is connected transversely to the end of the vertical plate 78 adjacent the notch 80 that is preferably tapered. The end plate 84 has an aperture 86 that aligns with aperture 60 on the latch 54 for receiving a locking pin (not shown). The notch 80 is formed to receive the arm 58 of the latch 54.

A stop 88 is welded to the bottom of I-beam 14 and an elongated handle (not shown) is connected to the exterior of the door panel 44. Also a support wheel 92 is connected to the door panel 44 by a bracket 94 to assist in opening and closing the door panel 44. For a door that opens inwardly, a secondary door 96 is hingedly connected to the door panel to allow one to enter the bin and clear grain in front of the door panel 44 so that the drive through door may open inwardly.

In another embodiment the latch 56 has a first bracket 98 attached to the outer door frame 20. The first bracket 98 has a top member 100 and a bottom member 102 that extend outwardly from the outer door frame 20 in parallel spaced relation. Preferably one end of the members 100 and 102 is tapered. A catch pin 104 extends through and between members 100 and 102.

A second bracket 105 is attached to a mounting plate 106 on the door panel 44. The bracket 105 has a top member 108 and a bottom member 110 that extend outwardly from the mounting plate 106 in parallel spaced relation. Both of the top 108 and bottom member 110 have a plurality of aligned lock pin holes 112 and a pivot pin hole 114 in vertical alignment.

A clamp assembly 116 is pivotally connected to the second bracket 105. Preferably, the clamp assembly 116 has a c-shaped section having a cross member 118 and a pair of side members 120 that extend laterally from cross-member 118. The side members 120 have a plurality of angled lock pin holes 122 and a pivot pin hole 124 that pivotally and selectively align with holes 112 and 114 of the top 108 and bottom member 110. The clamp assembly 116 is pivotally connected to the top 108 and bottom 110 members by a pivot pin 126 that extends through the pivot pin holes 124 of the side members 120 and pivot pin holes 114 of the top member 108 and the bottom member 110.

The side members 120 have a pair of second pivot pin holes 128 that are vertically aligned. A generally L-shaped handle 130 is connected to the cross-member 118. The handle 130 has a gripping section 132 that is welded to the cross member 118 of the C-section and a locking section 134. The locking section 134 has a second pivot pin hole 136 that is in vertical alignment with holes 128 on the side members 120. The locking section 134 also has a plurality of angled locking pin holes 138 that selectively align vertically with the locking pin holes 122 of the side members 120 and holes 112 of the top member 108 and the bottom member 110. Finally, the locking section 134 has pivot hole 139 that aligns with holes 124 and 114 to receive pin 126. A hook member 141 is pivotally connected to the handle 130. Preferably, the hook member has a pair of spaced apart longitudinal arms 140 that are connected by one or more braces 142. A first end 144 of the longitudinal arms 140 have second pivot pin holes 146 that align with holes 128 on the side members 120 and hole 136 on the handle 130 to receive pivot pin 148. The second end 150 of the arms 140 terminate in an arcuate section that is formed to selectively receive the catch pin 104.

In operation, to lock the door panel 44, the handle 130, using the gripping section 132 is moved away from the first bracket 98 toward the second bracket 105. As the handle is moved the cross member 118 and side members 120 rotate about pins 126 and 148 such that the cross-member 118 fits over the ends 152 of the top 108 and bottom 110 members of the second bracket 105. The movement of the handle 130 also causes the locking pin holes 122 of the side members 120 and holes 138 of the handle 130 to align with a selected locking pin hole 112 of the top 108 and bottom 110 members such that a locking pin (not shown) may be inserted in the aligned holes 122, 138, and 112. Finally, the movement of the handle causes the arcuate section 150 of the hook member 141 to engage the catch pin 104 to securely lock the door panel 44 to the outer door frame 20. The angle of holes 122 and 138 in relation to aligned holes 112 allows one to draw the clamp assembly 116 tight to create more tension due to door warpage and the like.

To unlock the door panel 44 the handle 130 is moved toward the first bracket 98 which causes the arcuate section 150 to release from the catch pin 104 and cross-member 118 to release from the ends 152 of the top 108 and bottom members 110 of the second bracket 105.

Thus, a drive through bin door has been described that at the very least meets all the stated objectives. In particular, a drive through bin door has been described which eliminates the need for field welding, which often is performed by a non-certified welder, and this improves the quality of the door.

What is claimed is:

1. A drive through bin door, comprising:

a bottom I-beam with an angle that closely follows a curvature of a grain bin;

an inner and an outer door frame each having a pair of C-channeled posts and an angled C-channeled member positioned above and connected to the posts wherein the door frames are connected to the bottom I-beam; and a door panel hingedly connected to one of the door frames.

2. The door of claim 1 wherein a bottom side of the top member has a plurality of openings that align with a plurality of openings on a top side of the posts such that the top member is connected to the posts by a plurality of nuts and bolts.

3. The door of claim 1 wherein a pair of vertical wall panel and a horizontal wall panel are sandwiched between the inner and outer door frames which are bolted together.

4. The door of claim 3 wherein a pair of sealing plates are connected to an inside and an outside of the horizontal wall panel and the vertical wall panel.

5. The door of claim 1 wherein a plurality of guides and an adjustable latch are connected to one of the door frames.

6. The door of claim 1 further comprising a secondary door hingedly connected to the door panel.

7. A drive through bin door, comprising:

a bottom I-beam;

an inner and an outer door frame each having a bottom side having a plurality of holes that align with openings in an upper flange of the bottom I-beam to connect the inner and outer door frames to the bottom I-beam;

a door panel hingedly connected to one of the door frames, and an adjustable latch assembly connected to the door panel and one of the door frames.

8. The door of claim 7 wherein the adjustable latch assembly includes a latch having an arm that is pivotally connected to the door panel and a catch having a vertical plate with a notch that receives the arm.

9. The door of claim 1 wherein the door is capable of assembly without field welding.

10. The door of claim 7 wherein the latch assembly has a first bracket with a catch pin attached to one of the door frames and a second bracket attached to the door panel wherein a clamp assembly is selectively moved to lock the door panel to the door frame.

11. The door of claim 7 wherein bolts extend through the plurality of holes and aligned opening and are received in spacers.

12. The door of claim 1 wherein the C-channeled member has a plurality of openings that extend through a portion of a bottom side of the C-channeled member and align with openings in a top side of the pair of C-channeled posts for receiving bolts secured by nuts.

* * * * *